US006435744B1

(12) United States Patent
Dunn et al.

(10) Patent No.: US 6,435,744 B1
(45) Date of Patent: Aug. 20, 2002

(54) TAPE PRINTING DEVICE AND TAPE CASSETTE

(75) Inventors: Anthony Roy Dunn, Cambridge; Sam Cockerill, Hartson; Costa Panayi, Royston, all of (GB)

(73) Assignee: Esselte N.V., Sint-Niklass (BE)

( * ) Notice: Subject to any disclaimer, the term of this patent is extended or adjusted under 35 U.S.C. 154(b) by 0 days.

(21) Appl. No.: 09/692,125

(22) Filed: Oct. 20, 2000

Related U.S. Application Data

(63) Continuation of application No. PCT/EP98/05952, filed on Sep. 18, 1998.

(30) Foreign Application Priority Data

Apr. 21, 1998 (GB) ..... 9808445

(51) Int. Cl.[7] ..... B41J 11/26
(52) U.S. Cl. ..... 400/621; 400/611
(58) Field of Search ..... 400/615.2, 611, 400/621, 207, 208

(56) References Cited

FOREIGN PATENT DOCUMENTS

| | | |
|---|---|---|
| EP | 0 526 213 | 2/1993 |
| EP | 0 567 298 | 10/1993 |
| EP | 0 634 276 | 1/1995 |
| JP | 05 169749 | 7/1993 |

OTHER PUBLICATIONS

Patent Abstracts of Japan, vol. 097, No. 003, Mar. 31, 1997; JP 08 300739, Nov. 19, 1996.

*Primary Examiner*—Andrew H. Hirshfeld
*Assistant Examiner*—Minh Chau
(74) *Attorney, Agent, or Firm*—Pennie & Edmonds LLP

(57) ABSTRACT

In order to improve and facilitate the peeling operation of a tape printing device of the type employing a tape cassette, a tape cassette (100) with an angled peel slot (110) is disclosed. The corresponding peel plunger (76) of the tape printing device is moving into the peel slot (110) during a peeling operation and the longitudinal axis of the peel slot (110) and the longitudinal axis of the tape (80) enclose a non-perpendicular angle, as well. Thus, only an edge (84) of the tape (80) is peeled, what reduces the forces required for peeling.

11 Claims, 10 Drawing Sheets

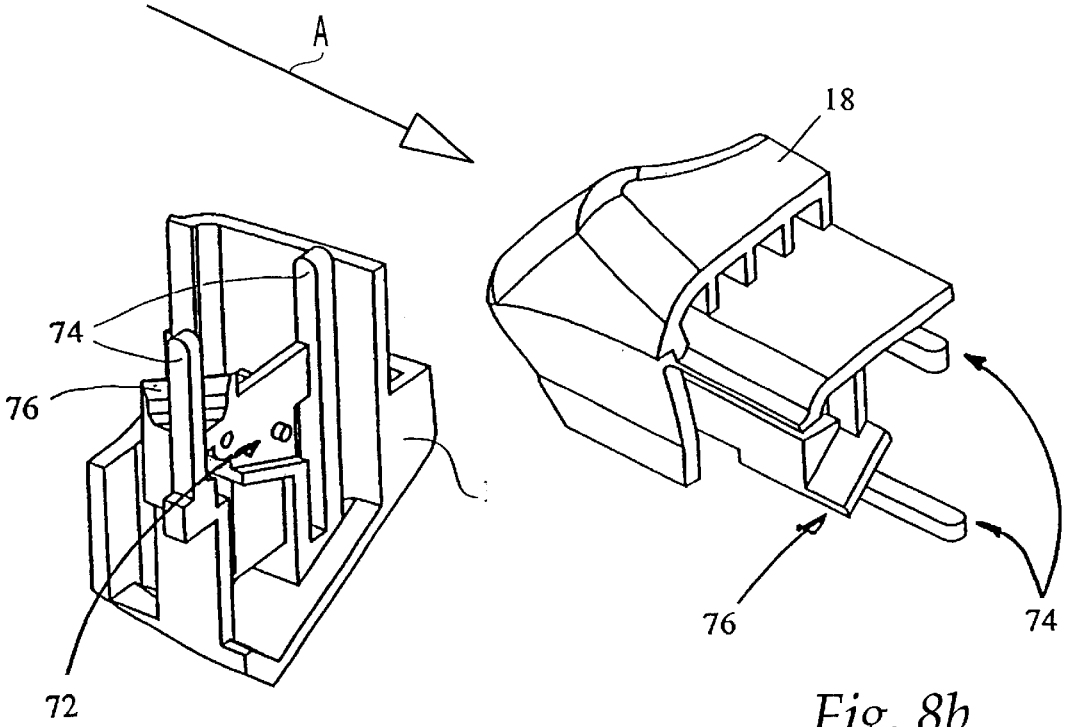
Fig. 8a
Fig. 8b
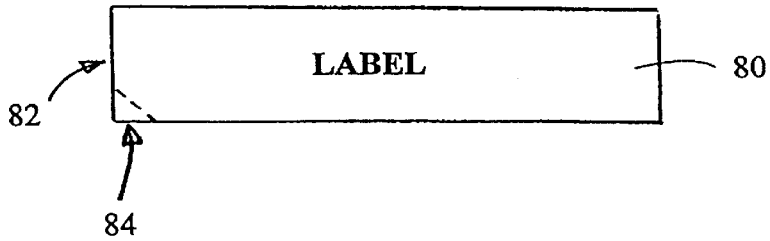
Fig. 10

TAPE PRINTING DEVICE AND TAPE CASSETTE

CROSS-REFERENCE TO RELATED APPLICATIONS

This application is a continuation of the U.S. national stage designation of PCT application PCT/EP98/05952 filed Sep. 18, 1998.

FIELD OF THE INVENTION

The present invention relates to a tape printing device and a corresponding tape cassette.

BACKGROUND OF THE INVENTION

Known tape printing apparatus of the type with which the present invention is generally concerned are disclosed in EP-A-322918 and EP-A-322919 (Brother Kogyo Kabushiki Kaisha) and EP-A-267890 (Varitronics). These tape printing apparatus each include a cassette receiving bay for receiving a cassette or tape holding case. In EP-A-267890, the tape holding case houses an ink ribbon and a substrate tape, the latter comprising an upper image receiving layer secured to a backing layer by an adhesive. In EP-A-322918 and EP-A-322919, the tape holding case houses an ink ribbon, a transparent image receiving tape and a double-sided adhesive tape which is secured at one of its adhesive coated sides to the image receiving tape after printing and which has a backing layer peelable from its other adhesive coated side. With both these apparatus, the image transfer medium (ink ribbon) and the image receiving tape (substrate) are in the same cassette.

Once an image is printed onto the tape, a user may wish to put the printed label onto an article to be labelled. Thus, it is necessary to remove the releasable backing layer from the label. For making this process easier, a number of proposals have been published.

EP-A-0526213 discloses a tape printer with a cutting and peeling mechanism, in which the tape is clamped between two cooperating, stepped surfaces. The mechanism is provided with a cutting blade, as well, such that during peeling, a length of tape is simultaneously cut off from its supply. One of these surfaces provides a slot, into which a plunger (=the other surfaces) protrudes when peeling is performed. A similar arrangement, wherein a stepped surface is located on both sides of a cutting blade is disclosed in EP-A-0567299.

EP-A-0634276 discloses a tape printer with a cutting and peeling mechanism, as well. The plunger moves the tape into a slot provided in a cassette wall, and during retracting the tape manually from the mechanism, the cut end of the tape slides along a wall of the slot, such that the two layers tend to separate and peeling occurs.

In the prior art, the plunger and the longitudinal axis of the tape are arranged to include an angle of 90°. Thus, peeling is performed by bending the tape over its entire width. Since a predetermined force is required for releasing the backing tape from the adhesive image receiving layer, and this force is proportional to the area in which peeling is performed, relatively high forces are required, which make the operation of the peeling device less user friendly.

The object of the present invention is thus to overcome at least a part of the disadvantages of the prior art.

SUMMARY OF THE INVENTION

According to the invention, there is provided a combination of a tape printing device and a tape cassette, wherein:

the tape printing device comprises a peel plunger, the tape cassette comprises a housing in which a supply of tape is provided, and a peel slot arranged for accomodation of the peel plunger is defined within a side wall of the housing, the tape comprises an adhesive covered image receiving layer and a backing layer, and a portion of the tape is located between the peel plunger and the peel slot, and the peel plunger is arranged to move the tape into the peel slot, characterized in that the longitudinal axis of the peel slot and the longitudinal axis of the tape enclose a non-perpendicular angle.

The invention thus addresses the problem of peeling of tape, ie. the separation of the image receiving layer and the releasable backing layer. The invention proposes to have a non-perpendicular angle between the longitudinal axis of the peel slot and the longitudinal axis of the tape (=feed direction). Since the slot and the plunger are arranged parallel, such that the plunger can move into the slot, the longitudinal axis of the active plunger surface and the feed direction of the tape enclose a non-rectangular angle, as well, which is the same as the angle between peel slot and feeding direction. The angle can be between 30° and 60°, preferably 45°. Since the peeled area is reduced, the peeling result is improved. The required force is made smaller, or the peeling result at a certain, available force (and thus area) is improved.

A corresponding tape cassette is also provided, with the following features:

a housing in which a supply of tape comprising an adhesive covered image receiving layer and a backing layer is contained, a peel slot arranged in a side wall of the housing for accomodating a peel plunger, whereby a portion of the tape is located at the side wall adjacent the peel slot, characterized in that the longitudinal axis of the peel slot and the longitudinal axis of the tape enclose a non-perpendicular angle.

Additional advantageous features are recited in the dependent claims.

BRIEF DESCRIPTION OF THE DRAWINGS

For a better understanding of the present invention and as to how the same may be carried into effect, reference will now be made by way of example to the accompanying drawings in which:

FIGS. 8*a* and 8*b* show a cutter button;

FIG. 10 shows a label with a peeled edge; and

Figure 1:
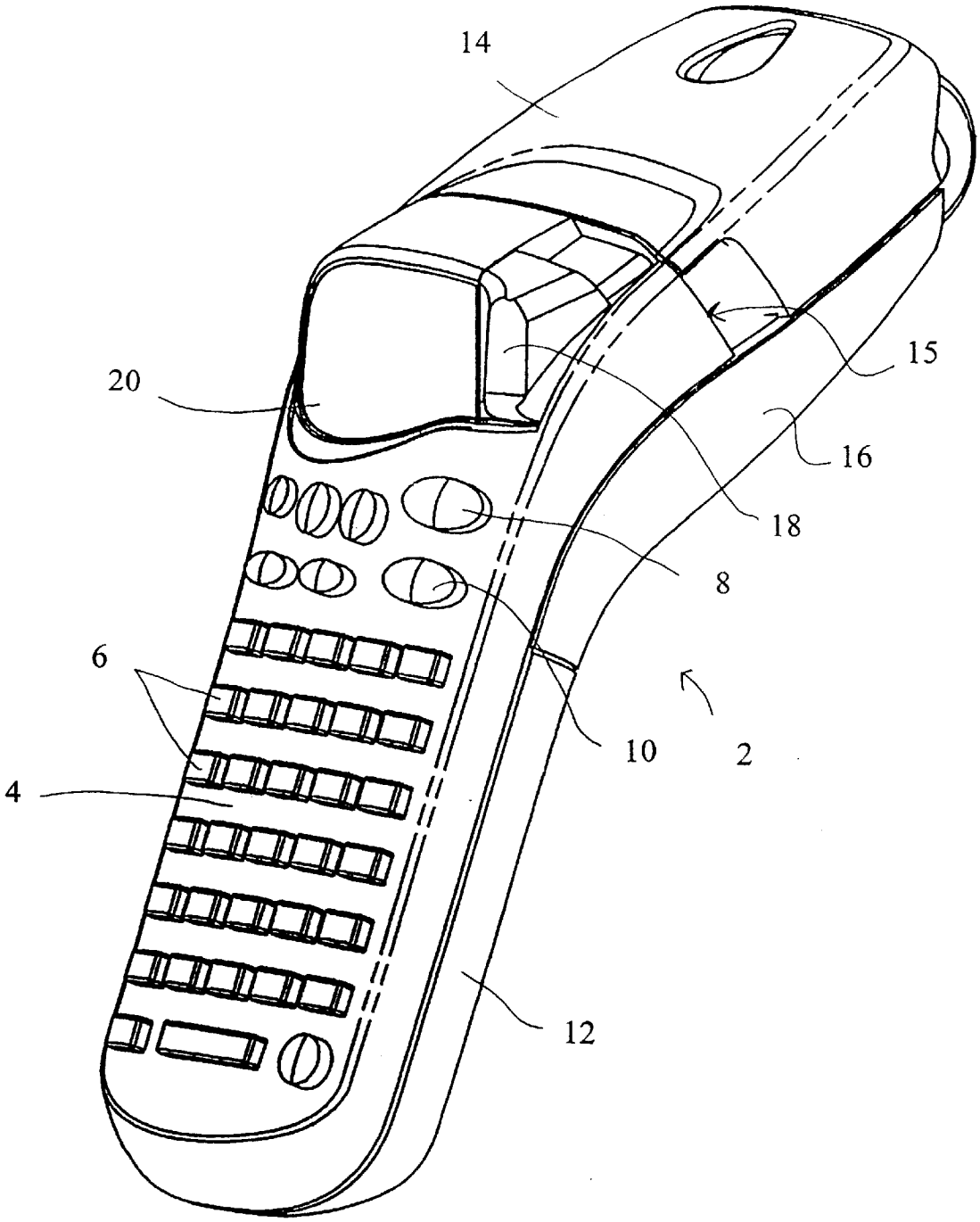
FIG. 1 is an isometric view of a tape printing device.

A tape printing device according to the present invention is shown in a perspective view in FIG. 1 and generally annotated with reference numeral 2. The tape printing device 2 comprises a housing which is essentially composed of two parts, one first, lower part containing a keyboard and a second, upper part in which a printing mechanism and a tape cassette is located and covered by a lid 14. The housing of the tape printing device 2 is composed essentially of five parts of casework.

A first part of this casework is a keyboard casework 4, in which a number of alphanumeric keys 6 for composing a label to be printed onto an image receiving tape are located. The keyboard comprises further keys 8, 10, which are a print key and a shift key. In order to distinguish these function keys from the alphanumeric keys 6, they are located at the upper end of the keyboard, and have a shape and possibly colour different from the alphanumeric keys 6. Some further functional keys are located left of the print key 8 and shift key 10, and are depressed by a user when it is desired to activate a key cap function, or a mode/shift function, or to move the cursor over the display. The design and functionality of the keys as such can be as described in our co-pending patent application GB 9806717.6. At the upper side of the keyboard casework, above the keys 6,8,10, a display cover 20 is housed within the keyboard casework 4. The display cover 20 is inclined with respect to the part of the surface of the keyboard casework 4 in which the keys 6, 8, 10 are located; the angle between display cover 20 (and a display inside the cover 20) and this surface is about 70°. This angle allows the user to hold the lower part of the tape printing device 2 with the keyboard in one of his hand, and to view the display inside the protective cover 20 easily, without disturbing reflections.

A second part of the casework is a battery cover 12 located on the opposite side of the housing with respect to the keys 6, 8, 10 of the keyboard. This battery cover 12 can be opened (removed or pivoted) in order to exchange batteries, when necessary. The latter are providing the tape printing device 2 with electric power, when operative. The keyboard casework 4 and the battery cover 12 thus constitute and enclose the first part of the housing of the tape printing device 2. Since only the keyboard (together with a corresponding printed circuit board) and the batteries are mounted within this first part of the housing, the first part is designed slim and is easy to handle, even for people with relatively small hands.

The second part of the housing of the tape printing device essentially contains a printing mechanism and a tape cassette as discussed below. A third part of the casework is thus a lid 14 which covers the printing mechanism which will be shown and described with reference to FIGS. 5–7. The lid is on its upper end (opposite to the display cover 20) pivotally mounted to a fourth part of the casework, which is a lower casework denoted with reference numeral 16. The lid 14 is located on the top side of the second part of the housing, such that a tape cassette is inserted from the top side, as well. The printing mechanism and the tape cassette are hence housed between the lid 14 and the lower casework 16, which both in combination constitute the second part of the housing of the tape printing device 2, together with a cassette bay casework (described later with reference to FIG. 6) for holding the tape cassette. This second part is arranged with a backwards inclination to include an angle of about 45° with the first, lower part of the housing of the tape printing device (containing the keyboard), whereby the first part and the second part of the housing are—when considered independently—generally of approximately cubic shape. This angled arrangement has ergonomic advantages, as well, since the bottom surface of the lower casework 16 can rest on the hand (particularly the forefinger) of a user when he or she holds the tape printing device 2 in his or her palm. Due to flat surfaces on the outer ends of the battery cover 12 and the lower casework 16, the device 2 can as well be placed onto a table for operation. It should be noted that the first part and the second part of the housing could be connected by means of a hinge or fulcrum, such that a foldable arrangement is obtained, yielding the advantage of a reduced storage space.

On the right side of the display cover 20, a cutter button 18 is located, which is depressed by a user when it is intended to cut a printed label off. The functionality of the cutter button 18 will be explained later with reference to FIGS. 8–11. Further, a tape exit 15 is provided within the right side wall of the housing, the exit 15 being defined by a gap between lid 14 and cassette bay casework. The tape emerges through the exit 15 after it has been printed. By depressing the cutter button 18, the user can cut off the printed label from the tape supply housed in the tape cassette.

Figure 2:
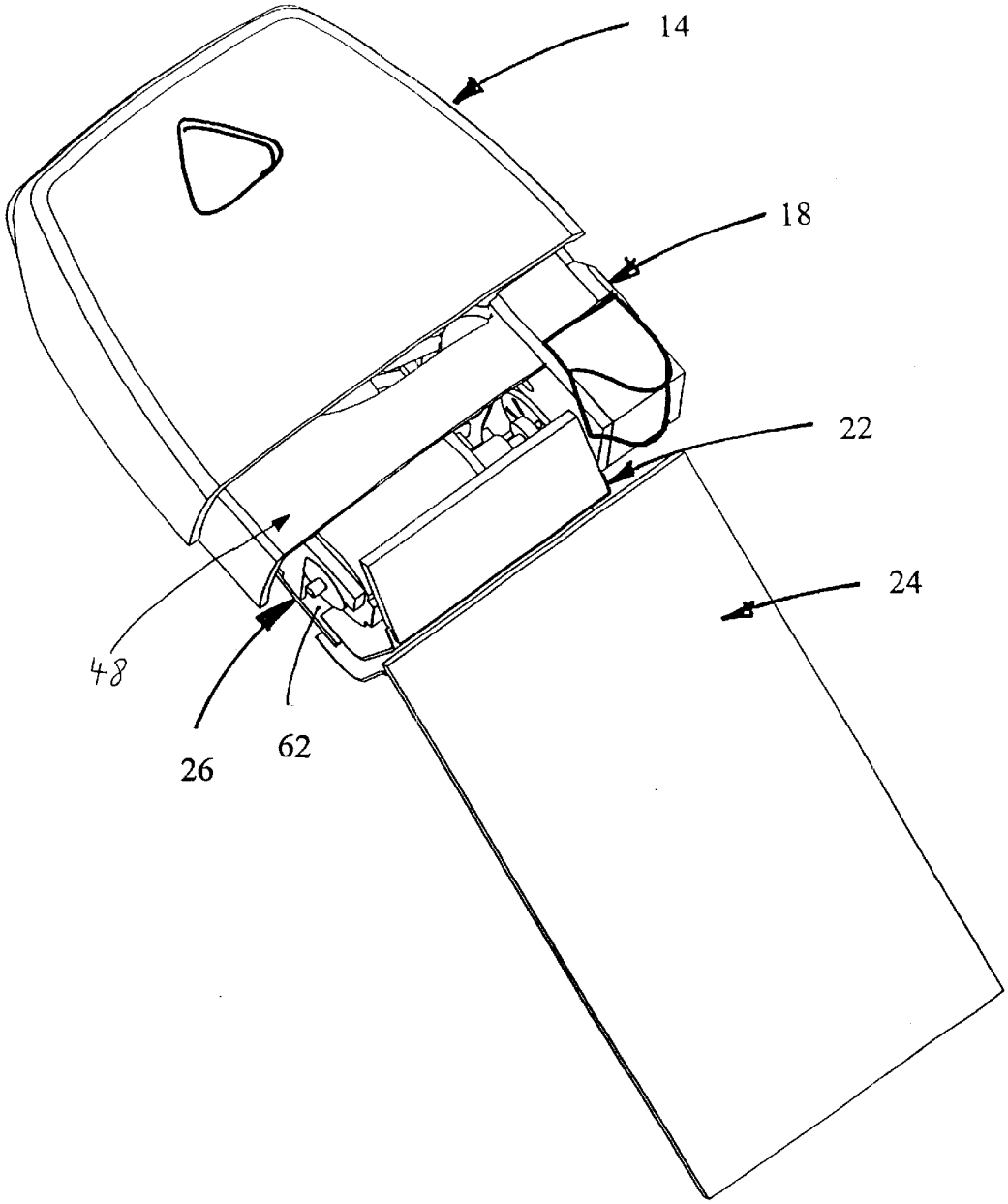
FIG. 2 shows the device with removed casework.
Figure 5:
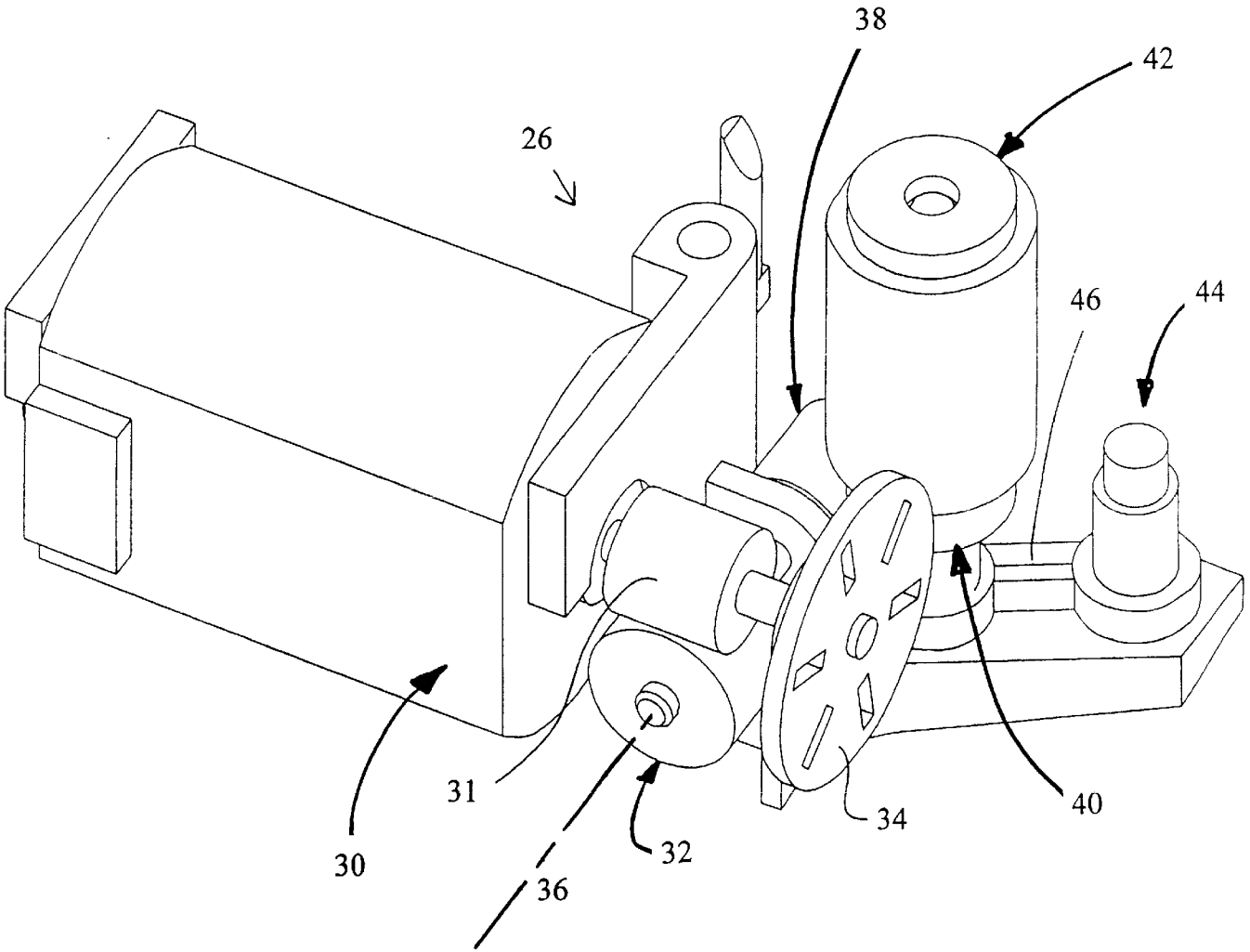
FIG. 5 shows a printing mechanism of the device.
Figure 7:
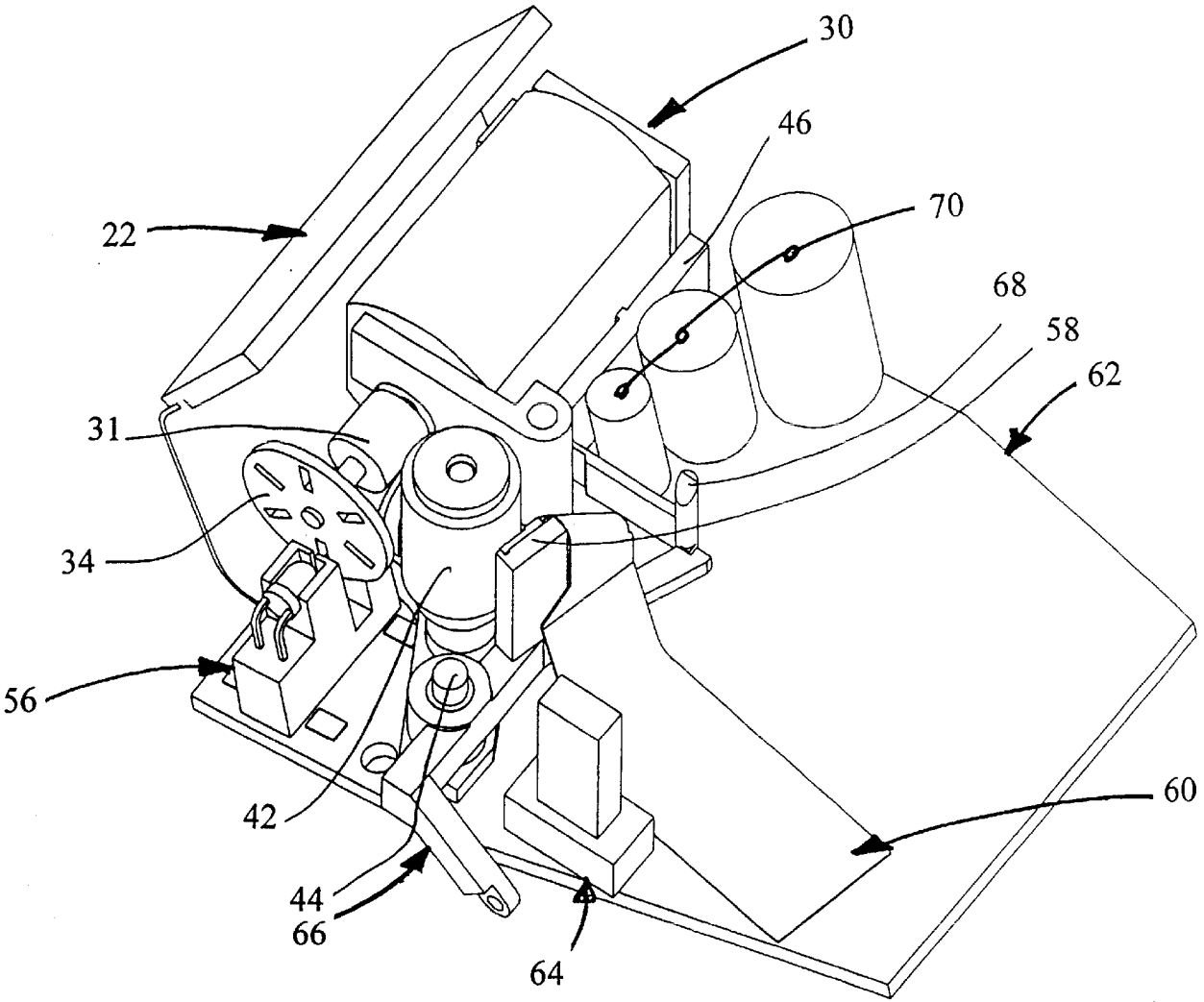
FIG. 7 shows the printing mechanism, with printhead.

FIG. 2 gives a perspective view of the tape printing device of FIG. 1, whereby the keyboard casework 4, the battery cover 12 and the lower casework 16 are removed, in order to display the interior of the first part of the housing. This part essentially only houses a printed circuit board (PCB) 24 for the keyboard, and the keys 6, 8, 10 as such, which are removed in FIG. 2 for the sake of simplicity. The printed circuit board 24 is electrically connected to a main printed circuit board (main PCB) 62 within the second part of the housing. The main PCB 62 is further connected to a liquid crystal display 22, which is normally protected by (and visible through) the display cover 20. Parts of a print mechanism 26 are visible within the second part of the housing, however most of the print mechanism 26 is in FIG. 2 covered by the lid 14, but is shown in FIG. 5 and 7. A cassette bay casework 48 is visible beneath the lid 14. The cassette bay casework 48 accomodates the tape cassette, and the cassette bay casework 48 and the lower casework 16 together form the hinge for the lid. Thus, the tape cassette is between the lid and cassette bay casework 48, and the print mechanism is mounted on the cassette bay casework 48 and between this and the lower casework 16. An advantage of the separate keyboard casework 4 is that only the casework 4, and possibly the keys 6,8,10 are specific for a designated country (in which a specific one of different sets of characters is required), while the entire remaining parts of the tape printing device are independent on the country-specific set of characters. It would thus be sufficient to have a stock of country-specific keyboard caseworks 4 and—when necessary—keys 6,8,10 (usually provided on a rubber keymat), which could be used to complete partially assembled tape printing devices 2 according to the number of orders from the respective countries. In this case, the microprocessor of the tape printing device controlling the print head and the display 22 would have to be instructed about the type of keyboard being used. This can be performed manually by solder links (eg. on the keyboard PCB), microswitches depressed by the keyboard casework 4 (a country-specific keyboard casework depresses specific microswitches), or by one or more carbon pills depressed by a certain feature on the keyboard casework 4, arranged to close country-specific contacts.

Figure 3:
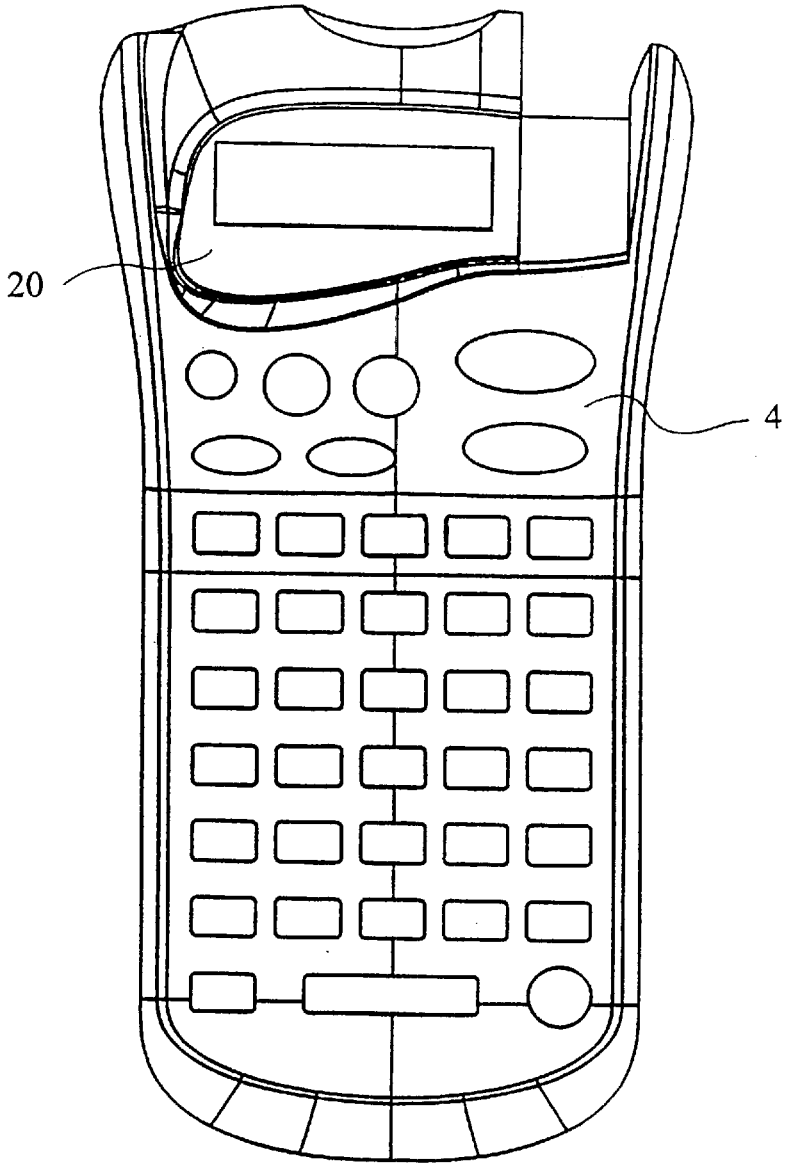
FIG. 3 shows a casework of the keyboard.

FIG. 3 is a perspective view onto the keyboard casework 4, which comprises a number of holes in which the respective keys are located when the tape printing device is assembled. The display cover 20 is mounted at the upper end of the keyboard casework 4 and partially printed for design purposes, whereby a rectangular part in the center is left free, for maintaining the display 22 visible.

Figure 4:
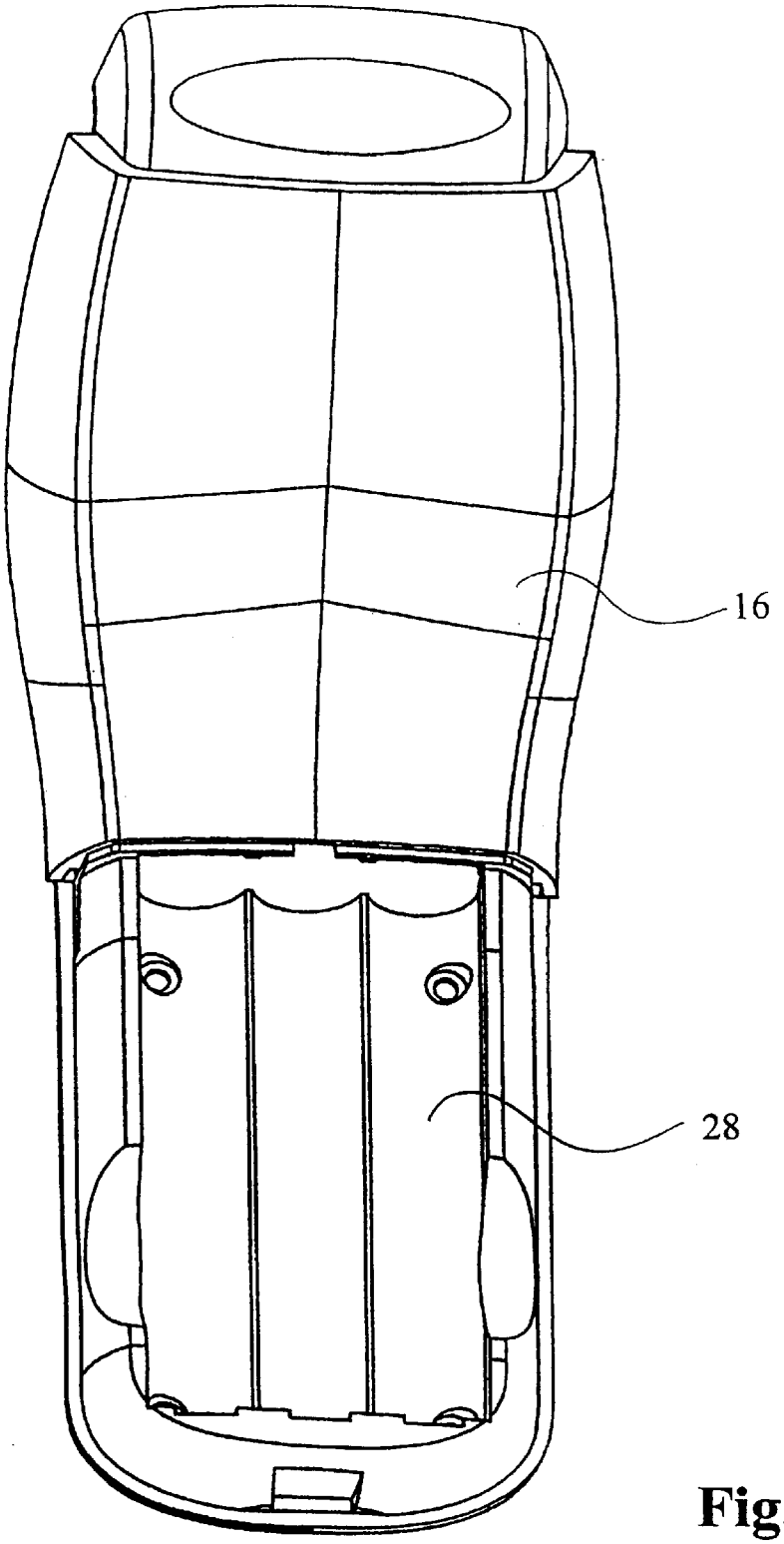
FIG. 4 shows a lower casework.

In FIG. 4, a perspective view from the bottom of the tape printing device 2 is shown. The battery cover 12 is removed, such that a battery housing 28 for accomodating batteries is revealed. The battery housing 28 is a moulded part of the lower casework 16. The battery cover 12 is retained by a clip at the lower end, and is slidable on the lower casework 16.

An isometric view of a part of the printing mechanism 26 is given in FIG. 5. The printing mechanism 26 comprises a baseplate 46 which is a unitary moulded plastics part. On the baseplate, a DC motor 30 is mounted. On the rotational axis of the motor, a first worm gear 31 is mounted, and an encoder disc 34. The purpose of the encoder disc will be described below. The first worm gear 31 drives a first worm wheel 32 which rotates around a drive shaft axis 36 enclosing an angle of 90° with the rotational axis of the motor, and drives a second worm gear 38. The second worm gear 38 is moulded onto a holder carrying a platen roller 42. Since the first worm wheel 32 and the second worm wheel 40 each comprise 14 teeth, a drive reduction ratio between motor 30 and platen roller 42 of 14·14=196 is obtained. An advantage of the worm gears is that a compact arrangement of the drive system is obtained. The baseplate 46 holds the DC motor 30, the drive shaft axis 36, the platen roller 42 (by means of a pin on which the roller 42 is mounted), and further comprises a printhead pin 44 for pivotally mounting a printhead holder. The baseplate 46 is provided with reinforcement ribs for enhancing the mechanical stability.

Figure 6:
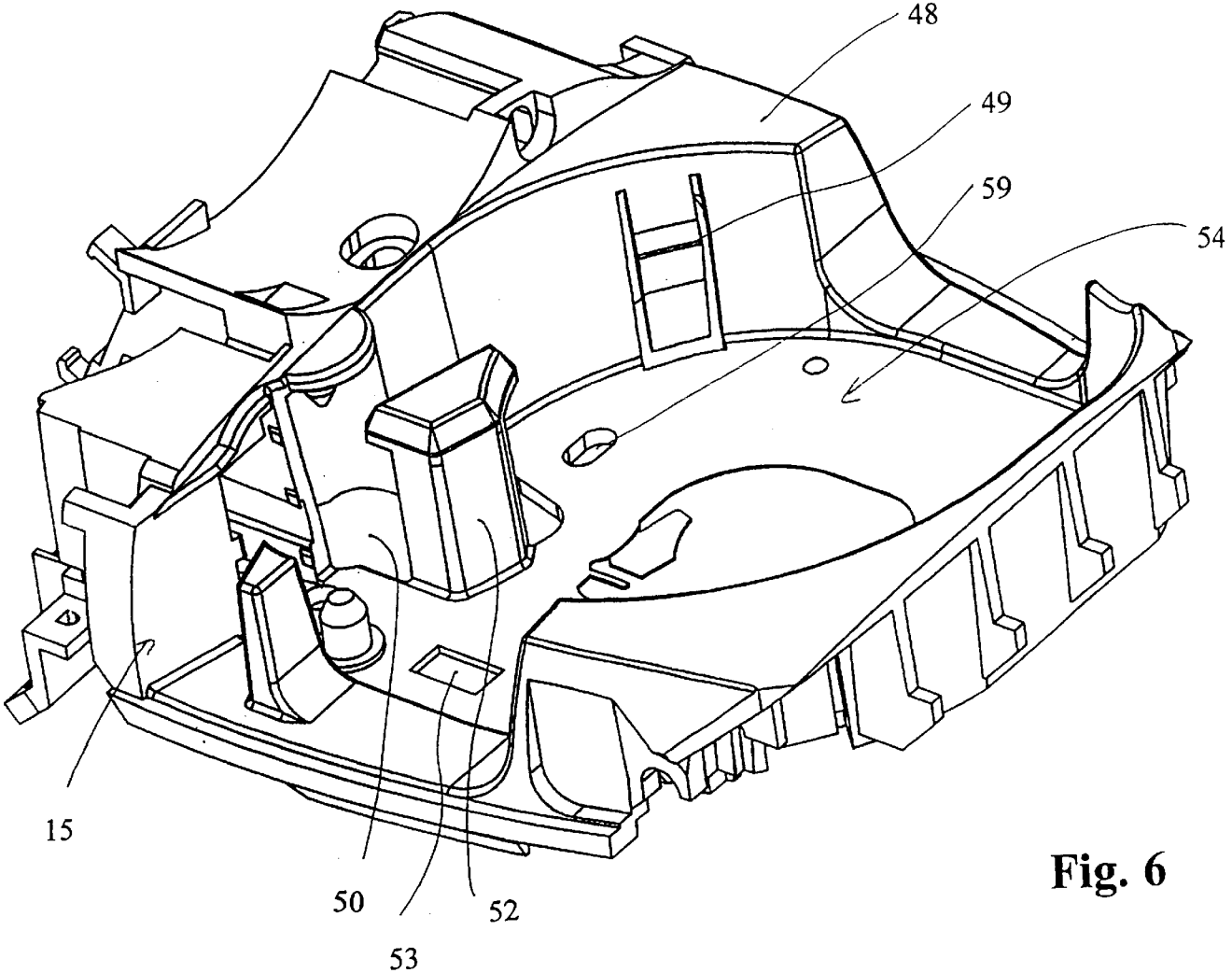
FIG. 6 shows a cassette bay casework.

In FIG. 6, an isometric view of a cassette bay casework 48 is given, which is in FIGS. 1 and 2 hidden by the lid 14. The cassette bay casework 48 forms in fact a fifth part of the casework of the housing of the tape printing device 2, and defines a cassette bay 54 in which a tape cassette (not shown) can be accomodated. In an assembled state, the cassette bay casework 48 is located below the lid 14 as shown in FIG. 1, wherein the tape exit 15 is located adjacent the lower front side of the cassette bay casework 48. The printing mechanism 26 mounted on the main PCB 62 is sandwiched between the cassette bay casework 48 and the lower casework 16. These three parts are fixed together, eg. by means of screws or a snap-in connection. In the bottom of the cassette bay casework 48, a hole 50 is located through which the platen roller 42 protrudes, when the tape printing device is in assembled state. Adjacent the hole 50, a protection cover 52 is provided, which extends over the print head (when assembled), in order to avoid that the user damages the printhead when a cassette is inserted. A slot 53 is provided in the bottom of the cassette bay casework 48, which is protruded by a media type switch 64 (see FIG. 7). Another hole is denoted with reference numeral 59; it is for the cassette sensing pin 68 of FIG. 7. Finally, the cassette bay casework 48 is provided with a retaining clip 49, for holding a tape cassette in position.

FIG. 7 represents the printing mechanism mounted to the main PCB 62. In particular, the baseplate 46 carrying the printing mechanism is fixed to the main PCB 62. As can be seen from the Figure, the printing mechanism comprises the motor 30, with the first worm gear 31 and the encoder disc 34 on its axis. The platen roller 42 is mounted to the baseplate 46, and driven by the motor 30 with the worm gears and worm wheels, as explained with respect to FIG. 5. Additionally, a printhead holder 66 is located on the printhead pin 44, and mounted for pivoting motion. A printhead 58 is fixed on the printhead holder 66, such that it can be moved towards the platen roller 42 for printing. When operative, an image receiving tape is located between the platen roller 42 and the printhead 58 with the sensitive side towards the printhead, and the printhead is urged against the tape. Since the platen roller 42 is driven by the motor 30, tape is during a printing operation fed from the printing location towards the tape exit 15, and the printhead is electrically activated such that its heating elements print the desired image under control of a microprocessor onto the image receiving tape, which is in the described embodiment of the invention a direct thermal printing tape. It would be possible to design the tape printing device to accomodate a tape for thermal transfer printing, as well, this would however involve a capstan for the ink ribbon rewind. The printhead holder 66 carrying the printhead 58 is pivotally mounted such that it can be pivoted between an operative position in which the image receiving tape is clamped between the printhead 58 and the platen roller 42, and an inoperative position, which allows to change the cassette holding the image receiving tape. This pivoting movement is coupled with the lid 14. In particular, when the lid 14 is opened, the printhead 58 is brought into the inoperative position leaving a gap between printhead 58 and platen roller 42, allowing to exchange the tape. When the lid 14 is closed, the printhead 58 is moved towards the platen roller 42, but can only get in contact with the latter when a tape cassette is inserted. Thus, a cassette sensing pin 68 is provided which blocks the pivoting movement of the printhead holder 66 when no cassette is inserted. When however a cassette is inserted, the cassette sensing pin 68 is shifted out of the range of movement of the printhead holder 66, such that the printhead 58 can reach its operative position in which it is urged against the platen roller. Such a mechanism is described in more detail in WO-A 97/32731. The printhead 58 is connected to a controller circuit (usually microprocessor, not shown) on the main PCB 62 by means of a flexible cable 60. In order to control the speed of the DC motor 30, and to synchronize the strobe pulses sent to the printhead 58, a light barrier 56 is provided interacting with the encoder disc 34. This is performed as described in EP-A-0 741044. On the main PCB 62, a number of capacitors 70 is mounted; and the LCD 22 is connected to the main PCB, as well. It should be noted that the cassette bay casework 48 as shown in FIG. 6 fits over the printing mechanism shown in FIG. 7, whereby the platen roller 42 protrudes through hole 50, and the cassette sensing pin 68 through the hole 59, such that they project into the cassette bay 54 for interacting with a tape cassette. A slide switch 64 mounted on the main PCB 62 protrudes through the slot 53 in the bottom of the cassette bay 54. This slide switch interacts with special features of the tape cassette and identifies the type of the image receiving tape, in order to adjust the printhead energy (strobe time or number of strobe pulses). The concept of the slide switch and interacting cassette is explained more detailled in EP-A-0634274.

The cutting mechanism implemented for cutting off a length of image receiving tape from the tape supply is illustrated in FIGS. 8*a* and 8*b*. FIG. 8*a* shows a bottom view of the cutter button 18, and FIG. 8*b* a side view. The cutter button 18 is provided with two upstanding blade guidance pins 74 which enter corresponding guidances in a tape cassette (see FIG. 9) during cutting operation. A blade mounting face 72 is provided between the pins 74; when the cutter button 18 is entirely assembled, a cutting blade (not shown) with an angled cutting edge is mounted on the blade mounting face 72. This cutting blade is operable to perform a guillotine cut. The cutter button 18 is further provided with a diagonally mounted peel plunger 76 downstream the cutting blade mounting face 72. The functionality of this plunger 76 will be explained with reference to FIGS. 9–11. The cutter button 18 is mounted in the keyboard casework 4 such that the cutter button of FIG. 8*b* is actuated in the direction indicated by arrow A, against the action of a spring.

Figure 9:
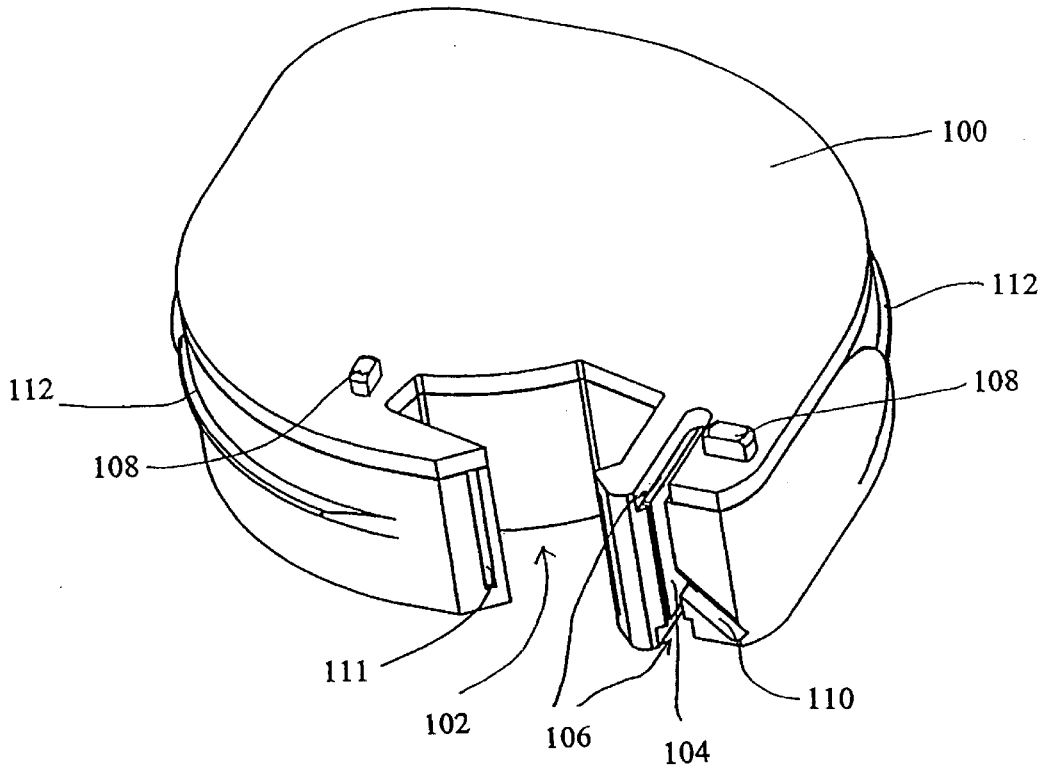
FIG. 9 is an isometric view of a tape cassette for use in the device.

An isometric view of a tape cassette 100 for use in the tape printing device 2 is shown in FIG. 9. An image receiving tape is contained therein, which is a direct thermal printing tape. An exit 111 is provided through which the front end of the tape leaves the cassette 100. Adjacent the exit 111, a recess 102 for accomodating the pivotally mounted printhead 58 is provided, as described in EP-A-0555942. Downstream the printing location defined by printhead 58 and platen roller 42, the cutting zone is located, wherein the cutting blade mounted to the cutter button 18 is arranged to cut off a printed portion of image receiving tape. This cutter blade is arranged to travel during cutting into a slot 104 defined in the side wall of the cassette 100, as described in EP-A-0634275. The two blade guidance pins 74 mounted to the cutter button 18 travel at the same time into corresponding guidances 106 arranged at both ends of the slot 104, as described in our copending European patent application 97118104.5. These guidances thus allow an improved alignment of cutting blade and slot 104. An important feature of the cassette 100 is a peel slot 110, which encloses an angle of about 45° with the longitudinal axis of the tape, as the peel plunger 76 of the cutter button 18. Thus, the peel plunger 76 travels into the peel slot during the cutting operation, in order to peel a backing layer of the image receiving tape off the image receiving layer. This will be explained with reference to FIGS. 10 and 11. The cassette 100 is on its top surface further provided with small upstanding retention features 108, which are approximately cubic. The bottom surface of the cassette 100 has corresponding recesses for accomodating retention features 108 of a second cassette, such that two cassettes 100 can be mounted (clipped) together and at a later time released (unclipped). This concept is described in our co-pending application PCT/EP 97/05065. On the side wall of the cassette 100, laterally overstanding retaining edges 1 12 are provided which interact with the retaining clips 49 in the cassette bay casework 48. Thus, the retaining edges 112 are depressed by the retainings clips 49 towards the bottom of the cassette bay 54, and the cassette 100 is held in the appropriate position for printing.

FIG. 10 illustrates the functionality of the cutting and peeling mechanism. It shows a portion of label tape 80 which has been cut off from the tape supply at a cut edge 82. The tape comprises as it is known in the art an image receiving layer, which is in the described embodiment a thermal sensitive layer (direct thermal printing layer), and a releasable backing layer which is secured to the image receiving layer by means of an adhesive. Once the non-adhesive backing layer has been removed from the image receiving layer, the latter can be stuck with its adhesive side onto an article to be labelled. A problem associated with tape printing devices in the state of the art is the separation of the backing layer and the image receiving layer. In the described embodiment, a peeling operation is performed by means of the peel plunger 76 and the corresponding peel slot 110 in the tape cassette 100. Since the plunger 76 and the slot 110 are arranged diagonally, a corner 84 of the tape 80 adjacent the cut edge 82 has been peeled, ie. the backing layer is separated from the image receiving layer. The user can then grasp the part of the backing layer which has been peeled of, and remove the backing layer entirely from the image receiving layer. The angle of the peel plunger 76 of about 45° with respect to the longitudinal axis of the tape 80 improves the performance in comparison with prior art devices, in which this angle is 90°, since a reduced area (about 25%) of the label is peeled for the same length of peel compared with the prior art. Further, the peel starts at a point (the lower right comer in FIG. 10) and is propagated towards the dotted line.

Figure 11A:
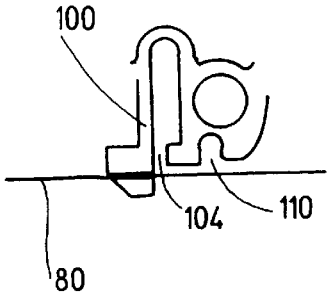
FIG. 11 illustrates the functionality of the peeling mechanism.
Figure 11B:
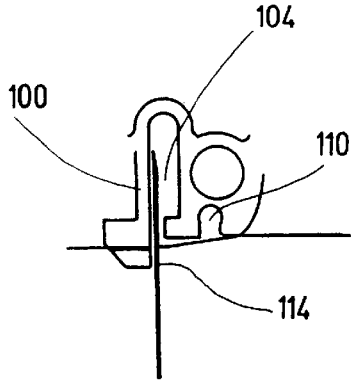
Figure 11C:
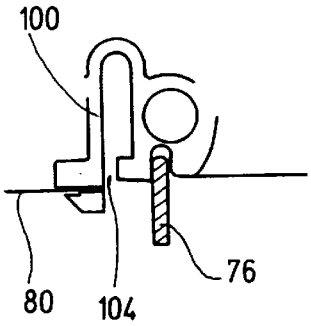
Figure 11D:
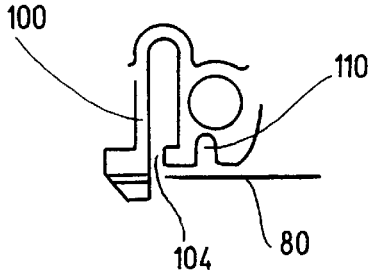

FIGS. 11*a* to 11*d* illustrate a horizontal section through the cutting mechanism during a cutting and peeling sequence obtained when the cutter button 18 is being depressed. In FIG. 11*a,* printed tape 80 is located at the cutting position, ie. adjacent the cutting slot 104 and the peel slot 110. In FIG. 11*b,* a blade 114 mounted to the blade mounting face 72 of the cutter button 18 cuts through the tape 80 and moves then into the cutting slot 104. Since the blade 114 projects more from the cutter button 18 than the peel plunger 76, the latter does not yet interact with the tape 80. When the cutter button 18 is now depressed further, the situation illustrated in FIG. 11*c* is obtained. Here, the cutter blade (although not shown) protrudes even deeper into the slot 104, and the peel plunger 76 presses the tape 80 adjacent the cut edge 82 into the peel slot 110. Thus, a bent is formed in the tape 80, such that the image receiving layer and the backing layer tend to separate. The peel plunger 76 does not necessarily have to protrude that far into the peel slot 110 such that the tape 80 is clamped between the plunger 76 and the bottom of the slot 110; it is sufficient when a gap larger than the tape thickness remains between plunger 76 and the bottom of the peeling slot 110. In FIG. 11*d,* the cutting blade 114 and the peel plunger 76 are retracted from the cassette 100, and the cut off portion of the tape can be torn out of the exit 15 of the tape printing device 2 by the user, thus obtaining a label as disclosed in FIG. 10. It should be noted that a brake (not shown) can be provided, which presses the tape 80 against a part of the side wall of the cassette 100 downstream the peel slot 110. This brake avoids misalignment of tape 80 and cutting blade 114 respectively peel plunger 76 during the cutting and peeling operation.

What is claimed is:

1. A combination of a tape printing device (2) and a tape cassette (100), wherein:

the tape printing device comprises a peel plunger (76), the tape cassette (100) comprises a housing in which a supply of tape (80) is provided, and a peel slot (110) having a longitudinal axis and arranged for accommodation of the peel plunger (76) is defined within a side wall of the housing, the tape (80) has a longitudinal axis and comprises an adhesive covered image receiving layer and a backing layer, and a portion of the tape (80) is located between the peel plunger (76) and the peel slot (110), the peel plunger (76) is arranged to move the tape (80) into the peel slot (110), and the longitudinal axis of the peel slot (110) and the longitudinal axis of the tape (80) enclose a non-perpendicular angle.

2. A combination according to claim 1, in which the angle is between 30° and 60°.

3. A combination according to claim 1, in which the angle is about 45°.

4. A combination according to claim 1, wherein the tape (80) is supported by parts of the side wall of the tape cassette (100) on either an upstream or downstream side of the peel slot (100).

5. A combination according to claim 1, wherein the peel plunger (76) and the peel slot (110) are arranged in parallel.

6. A combination according to claim 1, wherein a cutting blade (114) and the peel plunger (76) are mounted to a cutter button (18), which is slidably mounted to a housing of the tape printing device (2).

7. A combination according to claim 1, wherein a brake is provided, which is operable to press the tape (80) against a part of the side wall of the cassette (100) downstream the peel slot (110).

8. A combination according to claim 7, wherein the brake is connected with the cutter button (18).

9. A tape cassette (100) with the following features:

a housing in which a supply of tape (80) having a longitudinal axis and comprising an adhesive covered image receiving layer and a backing layer is contained, a peel slot (110) having a longitudinal axis and arranged in a side wall of the housing for accommodating a peel plunger (76), whereby a portion of the tape (80) is located at the side wall adjacent the peel slot (110), and the longitudinal axis of the peel slot (110) and the longitudinal axis of the tape (80) enclose a non-perpendicular angle.

10. A tape cassette according to claim 9, in which the angle is between 30° and 60°.

11. A combination according to claim 9, in which the angle is about 45°.

* * * * *

UNITED STATES PATENT AND TRADEMARK OFFICE

CERTIFICATE OF CORRECTION

PATENT NO. : 6,435,744 B1
DATED : August 20, 2002
INVENTOR(S) : Dunn et al.

It is certified that error appears in the above-identified patent and that said Letters Patent is hereby corrected as shown below:

Title page,
Item [73], Assignee, replace “Sint-Niklass” with -- Sint-Niklaas --.

Signed and Sealed this

Thirty-first Day of December, 2002

JAMES E. ROGAN
*Director of the United States Patent and Trademark Office*